US006128778A

United States Patent [19]

Castagneri

[11] Patent Number: 6,128,778

[45] Date of Patent: Oct. 10, 2000

[54] FINGERTIP PROTECTOR SET FOR SPORT GLOVES

[75] Inventor: Massimo Castagneri, San Mauro Torinese, Italy

[73] Assignee: Suntip S.A.S. Di Castagneri Massimo & C.,, Turin, Italy

[21] Appl. No.: 09/421,623

[22] Filed: Oct. 19, 1999

[51] Int. Cl.[7] ..... A41D 19/00

[52] U.S. Cl. ..... 2/21; 2/161.1; 2/163

[58] Field of Search ..... 2/21, 159–160, 2/161.1, 161.6, 161.3, 161.8, 163, 167, 168, 161.5; 128/880; 223/101

[56] References Cited

U.S. PATENT DOCUMENTS

| | | | |
|---|---|---|---|
| 1,916,921 | 7/1933 | Dougan | 2/21 |
| 3,248,112 | 4/1966 | Metzger | 2/21 |
| 3,500,477 | 3/1970 | Meszaros | 2/161.8 |
| 3,728,736 | 4/1973 | Pugh | 2/21 |
| 4,751,747 | 6/1988 | Banks et al. | 2/21 |
| 4,867,246 | 9/1989 | Kiger | 2/161.1 |
| 5,234,142 | 8/1993 | Loewan et al. | 2/21 |
| 5,577,272 | 11/1996 | Fisher | 2/21 |

*Primary Examiner*—John J. Calvert
*Assistant Examiner*—Tejash Patel
*Attorney, Agent, or Firm*—Joseph W. Molasky & Assoicates

[57] ABSTRACT

Fingertip protector for a sport glove for protecting and preventing wear to the palm sides of the fingertips, made of a single piece of rubber or elastomeric material, having a base portion and a perimeter edge forming two lateral portions and a frontal portion, the base portion having, on the external surface, a plurality of elongated protruding lines disposed longitudinally to the finger direction forming a first high grip area, and a plurality of concentric protruding lines forming a second high grip area.

8 Claims, 4 Drawing Sheets

FINGERTIP PROTECTOR SET FOR SPORT GLOVES

DESCRIPTION

1. Technical field

The present invention refers to a set of fingertip protectors for sport gloves.

More particularly the invention refers to a rubber fingertip protector for snowboard or carving gloves.

2. Background art

When practicing a sport like snowboard or carving it is necessary to wear particular protective gloves, similar to the classic ski gloves but more reinforced and better insulated. In fact the snowboarder, very often during the descent, rests one of his hands on the ground, dragging it on the snow or ice, for example when, during a turn, he bends his knees for improving the turning radius.

Considering the big stress to which the snowboard or carving gloves are exposed, in particular the internal side of the finger tips, it is evident the rapid wear which leads shortly to their damage and makes them unusable.

A solution to this problem is proposed in U.S. Pat. No. 5,924,137 wherein is disclosed a snowboard glove having sewn flexible leather panels on the internal side of the fingers. The material used for the panels must be flexible, as artificial leather, and therefore it should have a limited thickness. The use of stronger materials can therefore lengthen the glove useful life, however, when at least one of the finger protections is worn, it is necessary to buy a new pair of gloves. Moreover, in a glove realized according to the above-mentioned U.S. patent, the seams securing the panels to the fingertips are exposed to wear and reduce the durability of the glove.

SUMMARY OF THE INVENTION

An object of the present invention it is therefore to provide an improved set of fingertip protectors for sport gloves, in particular snowboard or carving or ski gloves.

Still another object of the invention is to provide a fingertip protector which does not interfere with the flexibility of the glove, does not have exposed seams and is easily replaceable by the user, protecting the glove from abrasive damage due to repeated contact with the snow or ice during snowboarding.

Another object of the invention is to provide a set of fingertip protectors having a better grip on the snow or ice.

The glove provided with the fingertip protector set according to the invention can advantageously be used in all applications wherein it is necessary to have an improved protection for the fingertips, a better grip and high flexibility.

BRIEF DESCRIPTION OF THE DRAWINGS

The invention will now be disclosed in detail with particular reference to the attached drawings illustrating non-limiting preferred embodiments of the invention, in which.

DETAILED DESCRIPTION OF THE INVENTION

Figure 1:
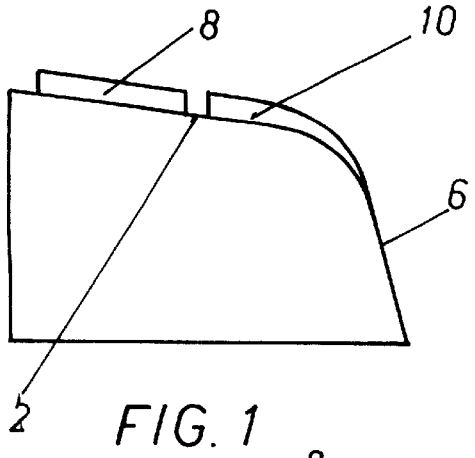
FIGS. 1 to 3 are isometric projections of a first type of a fingertip protector according to the present invention.
Figure 2:
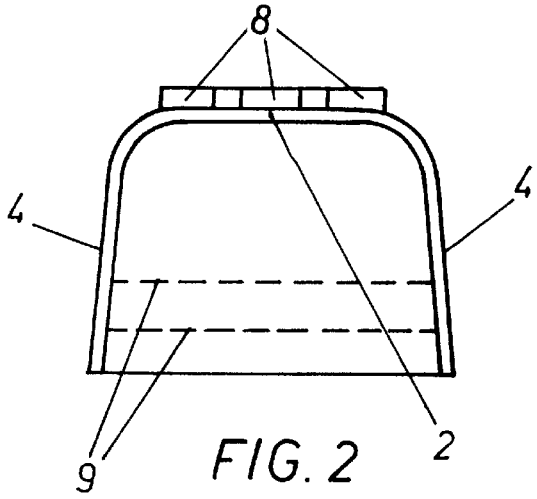
Figure 3:
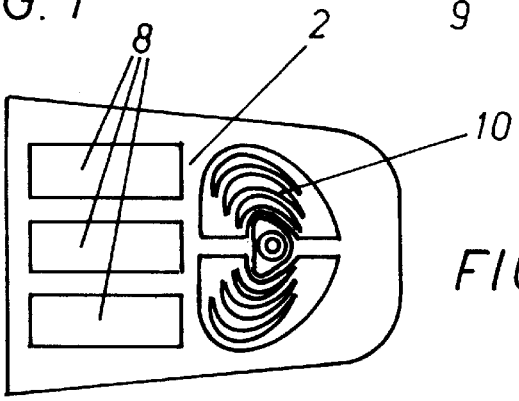

FIGS. 1 to 3 show an exemplary embodiment of a first type of fingertip protector according to the present invention.

The fingertip protector, obtained in a single piece by molding, is made of rubber or, in general, an elastomeric material in order to maintain a good flexibility in the gloves. It comprises a base portion 2 and a perimeter edge forming two lateral portions 4 and a frontal portion 6; the base portion 2 has, on the external surface, a plurality of elongated protruding lines disposed longitudinally to the finger direction, in particular, in the embodiment shown, there are three protruding elements 8, forming a first high grip area. The number of longitudinal elements is not restrictive, as a good flexibility is guaranteed with two or three elements as well as with a larger number of elements. The elements 8 are placed on the base portion 2 longitudinally relative to the direction of the fingers, in order to obtain a thicker surface that is flexible and easily adaptable to the finger tip shape.

The base portion 2 is moreover provided, on the tip, with a plurality of concentric protruding lines 10 forming a second high grip area. This second high grip area, which partially extends on the frontal portion 6, is very useful in particular to a snowboarder, as it facilitates the locking and release operations of the snowboard fastenings.

Figure 4:
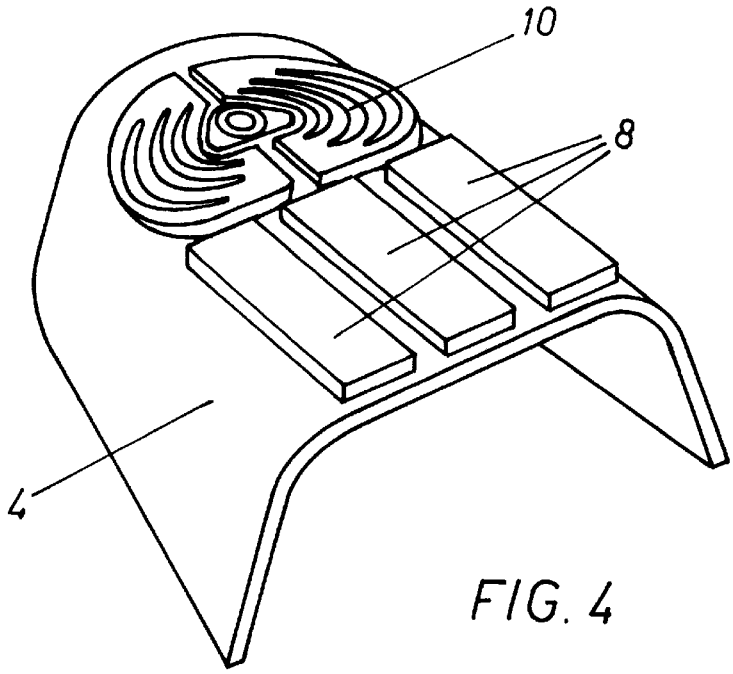
FIG. 4 is a perspective view of the fingertip protector shown in FIGS. 1 to 3 according to the present invention.

FIG. 4 shows, in a perspective view, the fingertip protector of FIGS. 1 to 3. The dimension and the shape of this protector has been designed to fit a forefinger, a middle finger or an annular of a snowboard or carving or ski glove. The internal surface of the protector is smooth so that it can be easily glued on the fingertip portion of the glove, using for example a cyanoacrylate adhesive. When a fingertip protector is worn or partially detached due to the stresses to which it is exposed, a suitable known solvent can be used for detaching the protector from the glove finger, and a new protector can be applied on the finger. This solution allows, at very low costs, to avoid glove wear and, contemporaneously, to obtain a better grip on the tip portions of the fingers.

Figure 5:
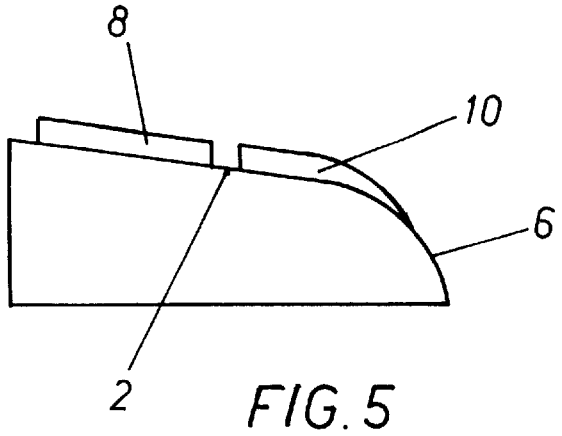
FIGS. 5 to 7 are isometric projections of a second type of a fingertip protector according to the present invention.
Figure 6:
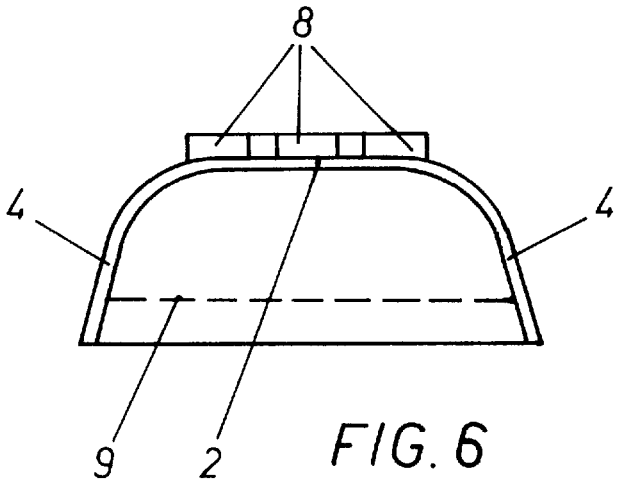
Figure 7:
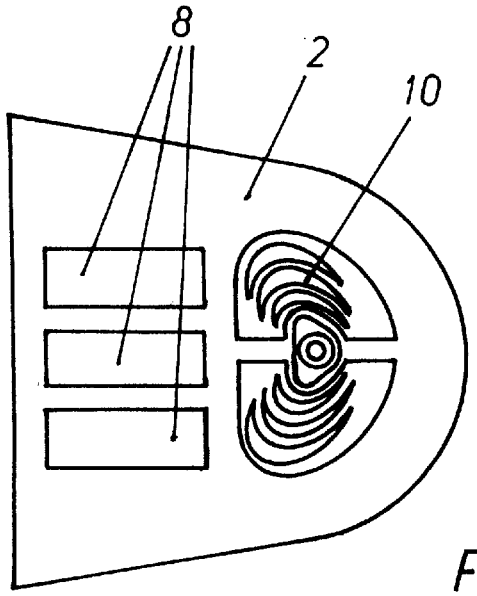

FIGS. 5 to 7 show an exemplary embodiment of a second type of fingertip protector according to the present invention, in particular a fingertip protector suitable for a thumb of a glove. The base portion 2, with the protruding lines 8 and 10, is larger, in order to adapt to the larger surface of the thumb, while the perimeter edge portions 4, 6 are narrower. The number and the design of the protruding lines forming the first and the second high grip areas are similar to that on the protector described above and shown in FIGS. 1 to 4.

Figure 8:
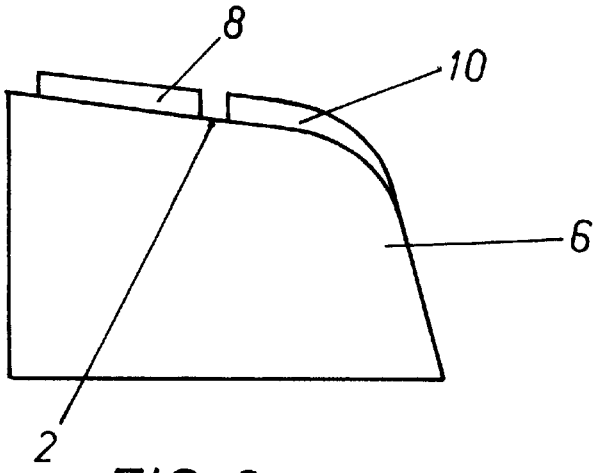
FIGS. 8 to 10 are isometric projections of a third type of a fingertip protector according to the present invention.
Figure 9:
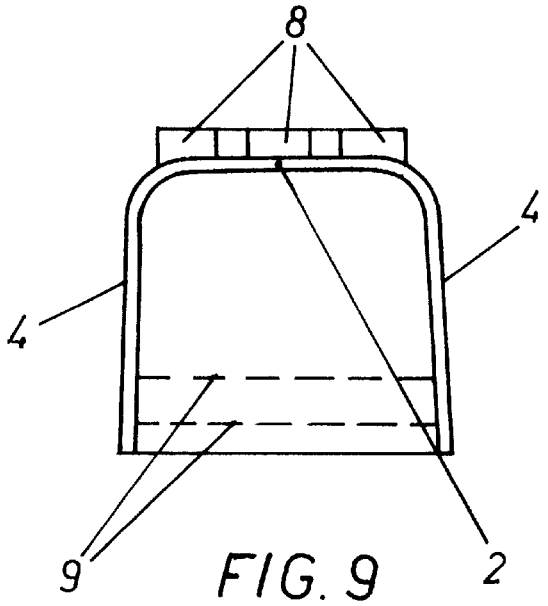
Figure 10:
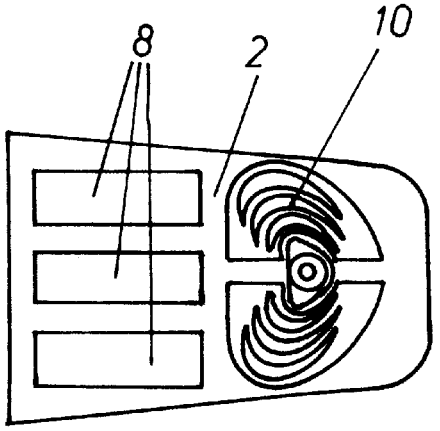

FIGS. 8 to 10 show an exemplary embodiment of a third type of fingertip protector according to the present invention, in particular a fingertip protector suitable for a little finger of a glove. The base portion 2, with the protruding lines 8 and 10, is smaller, in order to adapt to the smaller surface of the little finger, while the perimeter edge portions 4, 6 have substantially the same width as the protector shown in FIGS. 1 to 4. The number and the design of the protruding lines forming the first and the second high grip areas are similar to the other protectors above described.

Figure 11:
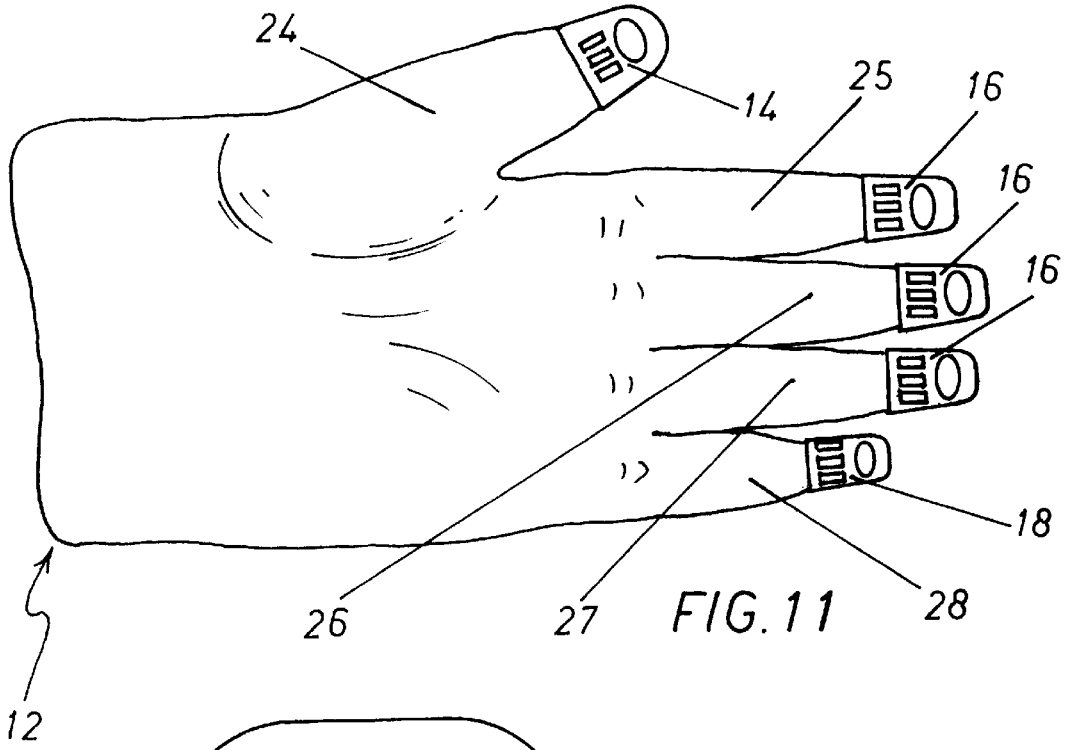
FIG. 11 is a view of the palm side of a snowboard or carving glove provided with a set of fingertip protectors according to the present invention.

FIG. 11 is a view of the palm side of a snowboard or carving glove provided with a set of fingertip protectors realized according to the present invention. A ski or snowboard or carving glove 12, made of fabric or synthetic materials, has five fingers 24–28, each finger having a fingertip protector 14, 16, 18. A thumb 24 has a fingertip protector 14 as the one shown in FIGS. 5 to 7, the forefinger 26, the middle finger 27 and the annular 28 each have a fingertip protector 16 as the one shown in FIGS. 1 to 4 and, finally, the little finger 28 has a fingertip protector 18 as the one shown in FIGS. 8 to 10.

The fingertip protector set according to the invention includes therefore five protectors, or ten protectors for a pair of gloves, and, optionally, a suitable quantity of adhesive. A user can easily apply the protectors on a pair of ski gloves and transform them into a pair of snowboard or carving gloves. Moreover, when the protectors are worn, it is not necessary to buy a new pair of gloves but it is sufficient to replace the worn protectors.

In order to adapt the fingertip protectors on several sizes of gloves they are provided, on the internal surface, with one or more cutting lines 9 running parallel to the edge suitable for cutting out, by means of scissors, an edge strip therefore reducing the size of the fingertip protector.

Figure 12:
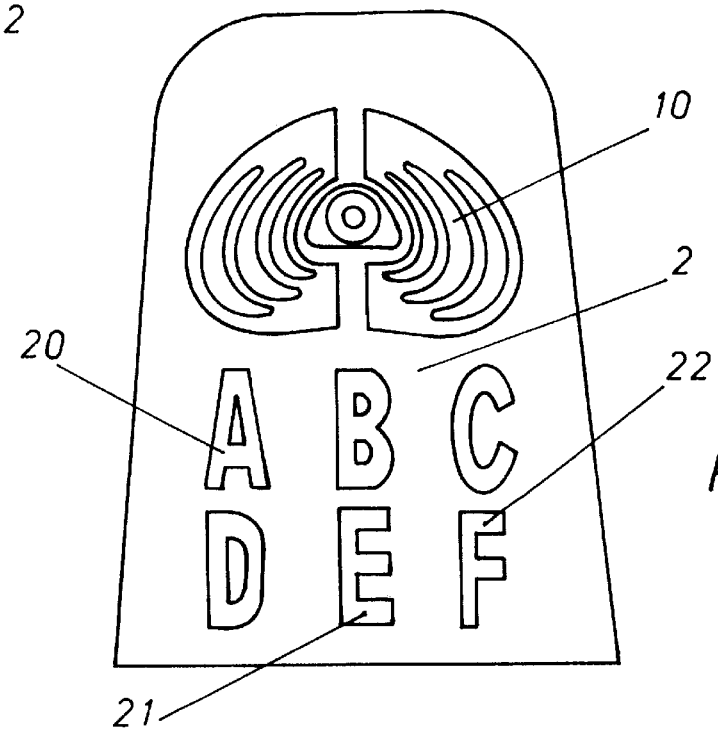
FIG. 12 is a top view a second embodiment of a fingertip protector according to the present invention.

FIG. 12 is a view of a second embodiment of a fingertip protector according to the present invention. The elongated protruding lines are replaced by protruding letters, numbers or symbols suitably spaced as to form three groups 20, 21 and 22 which allow the same flexibility as the protruding lines 8 of the embodiments previously shown. The symbols 20, 21, 22 can be used for an advertising message or a trade mark word.

The fingertip protectors have been described applied to a winter sport glove, however it is possible to apply the protectors to other types of sport or work gloves.

What is claimed is:

1. Fingertip protector for a sport glove for protecting and preventing wear to the palm sides of the fingertips, made of a single piece of rubber or elastomeric material, having a base portion and a perimeter edge forming two lateral portions and a frontal portion, said base portion having, on the external surface, a plurality of elongated protruding lines disposed longitudinally to the finger direction forming a first high grip area, and a plurality of concentric protruding lines forming a second high grip area.

2. Fingertip protector according to claim 1, wherein said concentric protruding lines extends partially on the frontal portion.

3. Fingertip protector according to claim 1, wherein the base portion provided with said protruding lines is thicker then the perimeter edge portions.

4. Fingertip protector according to claim 1, further provided, on the internal side of the perimeter edge portion, with at least one cutting line, running parallel to the edge, suitable for cutting out an edge strip and reducing the size of the fingertip protector, in order to adapt the protector to a smaller glove.

5. Fingertip protector according to claim 1, having a smooth internal surface which can be glued to the finger tip portion of a sport glove.

6. Fingertip protector according to claim 5, wherein said glue can be removed by means of a suitable solvent and the protector can be removed from the glove and replaced with a new protector.

7. Fingertip protector according to claim 1, wherein said elongated protruding lines are elongated protruding portions formed by adjacent protruding letters, numbers or symbols forming an advertising message or a trade mark word.

8. Fingertip protector set comprising a plurality of fingertip protectors according to claim 1, comprising at least three different types of protectors, a first type suitable for a thumb, a second type suitable for a forefinger, a middle finger or an annular, and a third type suitable for a little finger.

* * * * *